US008522450B2

(12) United States Patent
Moon et al.

(10) Patent No.: US 8,522,450 B2
(45) Date of Patent: Sep. 3, 2013

(54) CLOTHES TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Kwang Hee Lee, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 559 days.

(21) Appl. No.: 12/320,703

(22) Filed: Feb. 2, 2009

(65) Prior Publication Data

US 2009/0255141 A1 Oct. 15, 2009

Related U.S. Application Data

(63) Continuation-in-part of application No. PCT/KR2008/004522, filed on Aug. 4, 2008.

(30) Foreign Application Priority Data

Aug. 3, 2007 (KR) ..... 10-2007-0078295
Apr. 30, 2008 (KR) ..... 10-2008-0040898

(51) Int. Cl.
*F26B 3/34* (2006.01)
*F26B 25/06* (2006.01)
*A47B 88/00* (2006.01)

(52) U.S. Cl.
USPC ..... 34/264; 34/202; 34/218; 312/330.1

(58) Field of Classification Search
USPC ..... 34/72, 202, 225, 218, 264; 312/330.1, 312/334.14, 334.24, 334.9, 249.9
See application file for complete search history.

(56) References Cited

U.S. PATENT DOCUMENTS 1,454,494 A * 5/1923 Thomas ..... 312/334.9
1,940,626 A 12/1933 Holub
3,805,561 A 4/1974 Bullock
5,152,077 A 10/1992 Liang et al.
5,490,724 A * 2/1996 Domenig ..... 312/334.45
5,546,678 A 8/1996 Dhaemers
5,815,961 A * 10/1998 Estes et al. ..... 38/14

(Continued)

FOREIGN PATENT DOCUMENTS

CN 1037557 A 11/1989
EP 0 627 519 12/1994

(Continued)

*Primary Examiner* — Kenneth B Rinehart
*Assistant Examiner* — John McCormack
(74) *Attorney, Agent, or Firm* — McKenna Long & Aldrige LLP

(57) ABSTRACT

A clothes-treating apparatus is disclosed. According to the clothes treating apparatus, it is easy and convenient for a worker to have access to a mechanism compartment for maintenance and repair of the components. In addition, if the user chooses an easier method of accessing the components of the clothes treating apparatus the maintenance repair costs may be lowered. Furthermore, it is easy for a worker to remove and replace the components of the mechanism compartment. In addition, according to the clothes treating apparatus, the assembly line of the mechanism compartment may be separate from an assembly line of the clothes treating apparatus, which may enhance work efficiency.

12 Claims, 6 Drawing Sheets

(56) References Cited

U.S. PATENT DOCUMENTS

| | | | | |
|---|---|---|---|---|
| 6,101,835 | A * | 8/2000 | Butsch et al. | 62/390 |
| 6,425,192 | B2 | 7/2002 | Arrieta et al. | |
| 7,905,225 | B2 * | 3/2011 | Contarino | 126/41 R |
| 2006/0207277 | A1 * | 9/2006 | Mead et al. | 62/246 |
| 2010/0043245 | A1 * | 2/2010 | Noviello | 34/60 |

FOREIGN PATENT DOCUMENTS

| | | |
|---|---|---|
| EP | 1 205 592 | 5/2002 |
| EP | 1 975 306 | 10/2008 |
| GB | 2 428 692 | 2/2007 |
| WO | WO 2009/020329 | 2/2009 |

* cited by examiner

CLOTHES TREATING APPARATUS

This application is a Continuation-In-Part based on International Application No. PCT/KR2008/004522, filed on Aug. 4, 2008, and claims benefit under 35 U.S.C. §365(c) of the filing date of Korean Patent Application Nos. 10-2007-0078295 filed on Aug. 3, 2007 and 10-2008-0040898 filed on Apr. 30, 2008, all of which are hereby incorporated by reference in their entireties for all purposes as if fully set forth herein.

BACKGROUND ART

A clothes-treating apparatus refers to an apparatus which treats clothes placed in an accommodating space provided in a cabinet. Here, the term 'treat' means predetermined processes, for example, ventilating air to the clothes, supplying steam or hot air to the clothes to remove bad odors, wrinkles, and humidity that may remain on the clothes. As a result, a user can feel pleasant when putting on the clothes.

Specifically, when putting on a piece of clothes more than once, unpleasant odors, humidity, and the like may remain on the clothes and this may give an unpleasant feeling to a user who tries to wear the clothing again. In order to remove the odor or humidity, the clothing might be washed, however, repeated washing of clothing leads to shortened usage life, as well as high costs associated with the washing and dry cleaning of the clothing.

In addition to the above situation, even after washing and drying the clothes, wrinkles may remain. It is inconvenient for the user to perform additional chores like ironing and variations thereof before being able to immediately put on the clothes.

To solve these problems, a clothes-treating apparatus may be used to remove unpleasant odors, wrinkles and humidity which remain on clothes.

SUMMARY OF THE INVENTION

The present invention relates to a clothes-treating apparatus and a controlling method thereof. More particularly, the present invention relates to a clothes-treating apparatus in which the mechanical components can be easily maintained and repaired.

According to the clothes-treating apparatus, moisture may be supplied to clothes placed in an accommodating space to remove the unpleasant odors, wrinkles and humidity and air, including dry and hot air, is supplied to the clothes having much moisture because of sprayed steam to dry the clothes.

It may be effective only to expose the clothes to air or hot air when removing the unpleasant odors, wrinkles and humidity. The moisture may be supplied to the clothes to noticeably enhance the removal effect.

If moisture is supplied to the clothes placed in the clothes-treating apparatus, fine water particles are united with unpleasant odor elements remaining in the fabric of the clothing. The water elements which have united with odor elements may then separate from the clothes during a drying process, and be discharged outside. Accordingly, the unpleasant odors remaining on the clothes may be removed.

According to the above process, unpleasant odors, wrinkles and humidity remaining on the clothes may be removed and the user may put on the clothes with a pleasant feeling.

Typically, conventional clothes-treating apparatuses have a space for accommodating clothing to be treated. The accommodating space is formed in an upper portion of the cabinet and a mechanism compartment is positioned separately from the accommodating space. The mechanism compartment generally may have a moisture supply device for supplying moisture to the accommodating space, and an air supply device for ventilating air into the accommodating space.

When a user wishes to access the components provided in the mechanism compartment to maintain or repair the apparatus, a lower surface or a rear surface of the cabinet must be opened to gain access. It is, however, inconvenient and inefficient to disassemble major parts of a clothes-treating apparatus every time a user wishes to maintain or repair the inner components of the mechanism compartment.

A more efficient method of the access to the mechanism compartment positioned under the accommodating space is required, since such large portion of the inner space of the cabinet is composed of the accommodating space. The convenience of maintenance may also result in convenience of assembly of a clothes-treating apparatus.

To solve the problems, an object of the present invention is to provide a clothes-treating apparatus allowing for easy access to the inner components of a mechanism compartment, thus improving work efficiency.

In accordance with one aspect of the present invention, the advantages set forth below and other advantages may be achieved by a clothes treating apparatus that includes a cabinet having an accommodating space where clothes are placed; and a mechanism compartment separated and/or isolated from the accommodating space by a partition, the mechanism compartment comprising a moisture supply device supplying moisture to the accommodating space and an air supply device supplying dry or heated air to the accommodating space. An opening may be formed at a side surface of the mechanism compartment or the partition for an inside of the mechanism compartment to be exposed, and a module including at least one of the moisture supply device and the air supply device may be separable via the opening.

The present invention has following advantageous effects. According to the clothes treating apparatus, it is easy and convenient for a worker to have access to components provided in a mechanism compartment for the maintenance of the components. In addition, the worker may choose a method of having access to the components provided in the mechanism compartment and as a result the maintenance cost of the clothes treating apparatus may be lower. Furthermore, it is easy for a worker to mount the mechanism compartment and it is possible to reduce the assembly time of the clothes treating apparatus. In addition, according to the clothes treating apparatus, an assembly line of the mechanism compartment may be separable from an assembly line of the clothes treating apparatus, which enhances work efficiency.

BRIEF DESCRIPTION OF DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

DETAILED DESCRIPTION

Reference will now be made in detail to the specific embodiments of the present invention, examples of which are illustrated in the accompanying drawings. Wherever possible, the same reference numbers will be used throughout the drawings to refer to the same or like parts.

A clothes-treating apparatus according to an exemplary embodiment includes a cabinet and a mechanism compartment separated and isolated from the accommodating space by a partition. An accommodating space is formed in the cabinet to contain clothes. A moisture supply device supplying moisture to the accommodating space, and an air supply device supplying dry or heated air to the accommodating space may be provided in the mechanism compartment.

Figure 3:
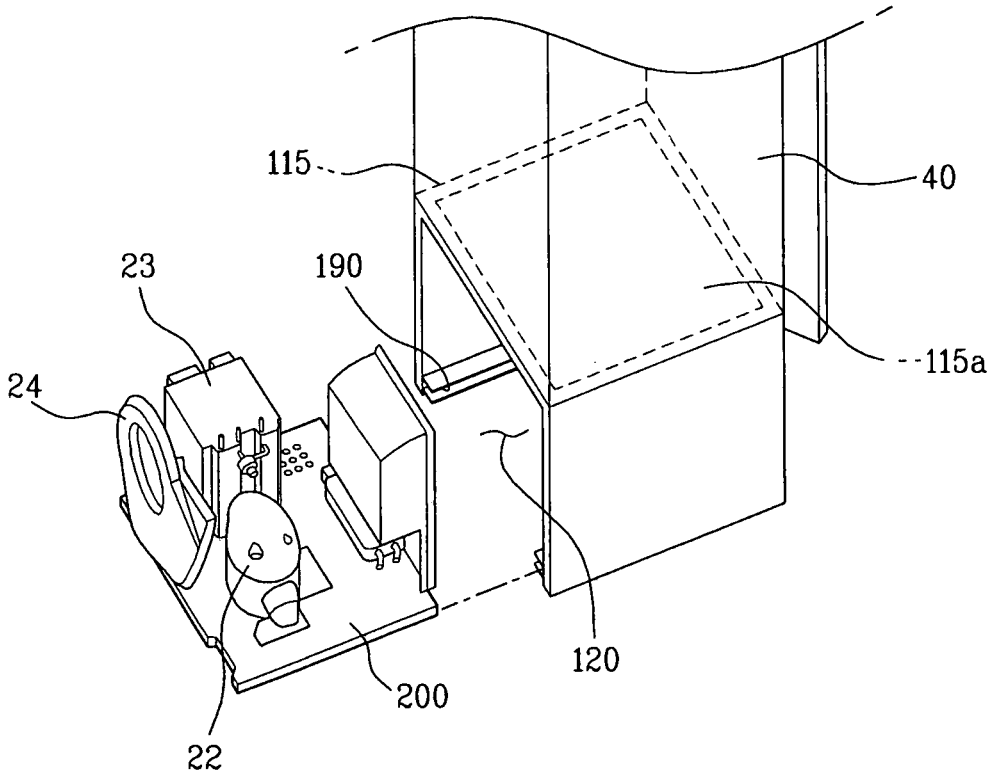
FIG. 3 is a diagram illustrating that the base plate having the components mounted thereon is separated from a cabinet having a guide member secured thereto.

An opening 122 may be formed at a side surface of the mechanism compartment 120, as illustrated in FIG. 3, to the interior of the mechanism compartment. However, one of skill will readily appreciate that the opening 122 could be provided at any of the side surfaces of the mechanism compartment or in the partition 115. Additionally, two or more openings 122 in the cabinet 40 may be provided to allow for multiple access points. A module that includes equipment in the mechanism compartment, comprising at least one of the moisture supply device and the air supply device, may be accessible and removable via the opening.

The module may be a single unit or comprise multiple sub-modules. Where multiple sub-modules are employed, the sub-modules may be independently movable or slideable in various directions depending upon the position of the openings, such that one sub-module may be removed in one direction through a first opening and a second sub-module may be removed in a different direction through a second opening, as illustrated, for example, in FIG. 4B.

The moisture supply device is a device supplying moisture to the accommodating space and the type of the moisture used has no limit. For example, the supplied moisture may be steam, sprayed water, a fine particle dispersion, or the like. The air supply device may be a device having a heating and/or dehumidifying function.

As a result, the module may include at least one of the moisture supply device and the air supply device. Here, the module may be unit structure of one or more parts capable of being separating from and wholly removed from the clothes-treating apparatus. In the module substantially every component inside the mechanism compartment may be modular or only particular components are made modular. It is preferable that the module includes at least one of the two components, i.e. the moisture supply device and the air supply device, because they occupy a large portion of the mechanism compartment.

Here, the moisture supply device should be interpreted to include general configuration to operate in a mode other than supplying the moisture to the accommodating space. For example, a water supply source supplying water to the moisture supply device may be modularized together with the moisture supply device.

Similarly, the air supply device may include a heating device adapted to heat or dehumidify air circulating air inside the accommodating space. The air supply device may include a heat pump-type heating device, having a heat exchanger and a compressor, circulation duct and a ventilation fan. The air supply device may also utilize a gas-type or electric-type heater. Accordingly, devices required to accomplish supplying air and moisture into the accommodating space may be modularized together with the air supply device and the moisture supply device.

Figure 1:
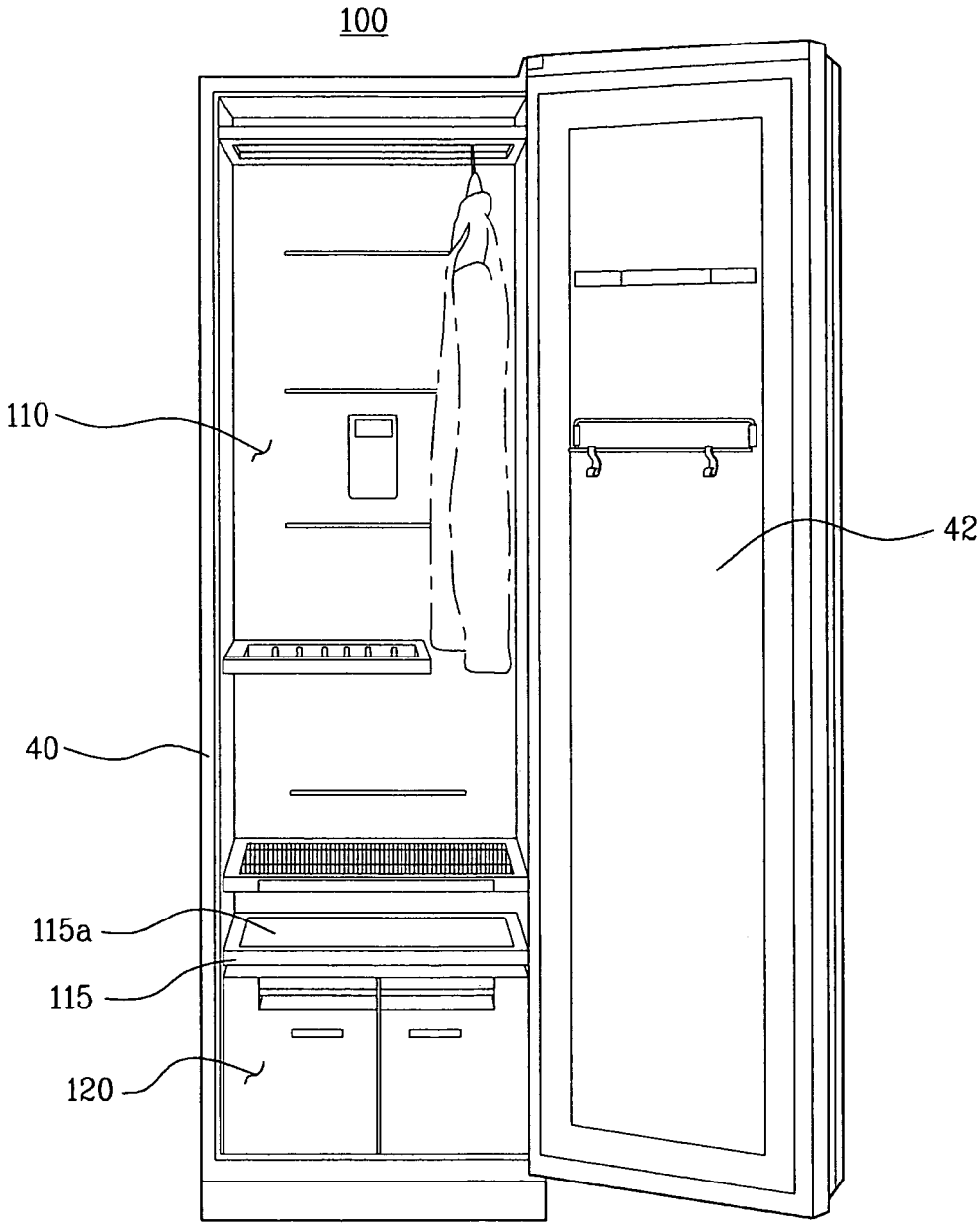
FIG. 1 is a diagram illustrating an exemplary embodiment of a clothes-treating apparatus.

FIG. 1 illustrates an exemplary embodiment of a clothes-treating apparatus 100. An accommodating space 110 is formed in an upper portion of a cabinet 40 and a mechanism compartment 120 is positioned under the accommodating space 110. It is noted that the location of the mechanism compartment 120 is not limited to being under the accommodating space 110, but may be disposed in various locations, e.g. at a side of or above the accommodating space 110, in the clothes treating apparatus 100 to accommodate specific design needs.

As mentioned above, an air supply device and a moisture supply device may be provided in the mechanism compartment 120. A partition 115 separates an inner space of the cabinet 40 into the accommodating space 110 and the mechanism compartment 120. The partition 115 may act to isolate (i.e., seal-off or substantially seal-off) the components located in the mechanism compartment 120 from the accommodating space 110.

A portion of the partition 115 may be separable such that a user may remove the separable portion 115*a* (hereinafter, a first cover) of the partition 115 to access the mechanism compartment 120. If the partition includes a separable portion, the first cover 115*a* may be provided in various types. The first cover 115*a* may also be entirely separable from the partition 115 or an end of the partition 115 may be attached by a hinge (not shown) so that it may be rotatable about the hinge. In this case, the accommodating space 110 may be formed above the mechanism compartment 120 and the first cover 115*a* may be positioned to be rotatable inward to the accommodating space 110.

Rotating the first cover 115*a* toward the accommodating space 110 allows a user to have access, via the accommodating space, to the various components provided in the mechanism compartment 120. While the first cover 115*a* shown in FIG. 1 provides easy access, it may still be inconvenient for the user to install and replace components in the mechanism compartment 120.

Figure 2:
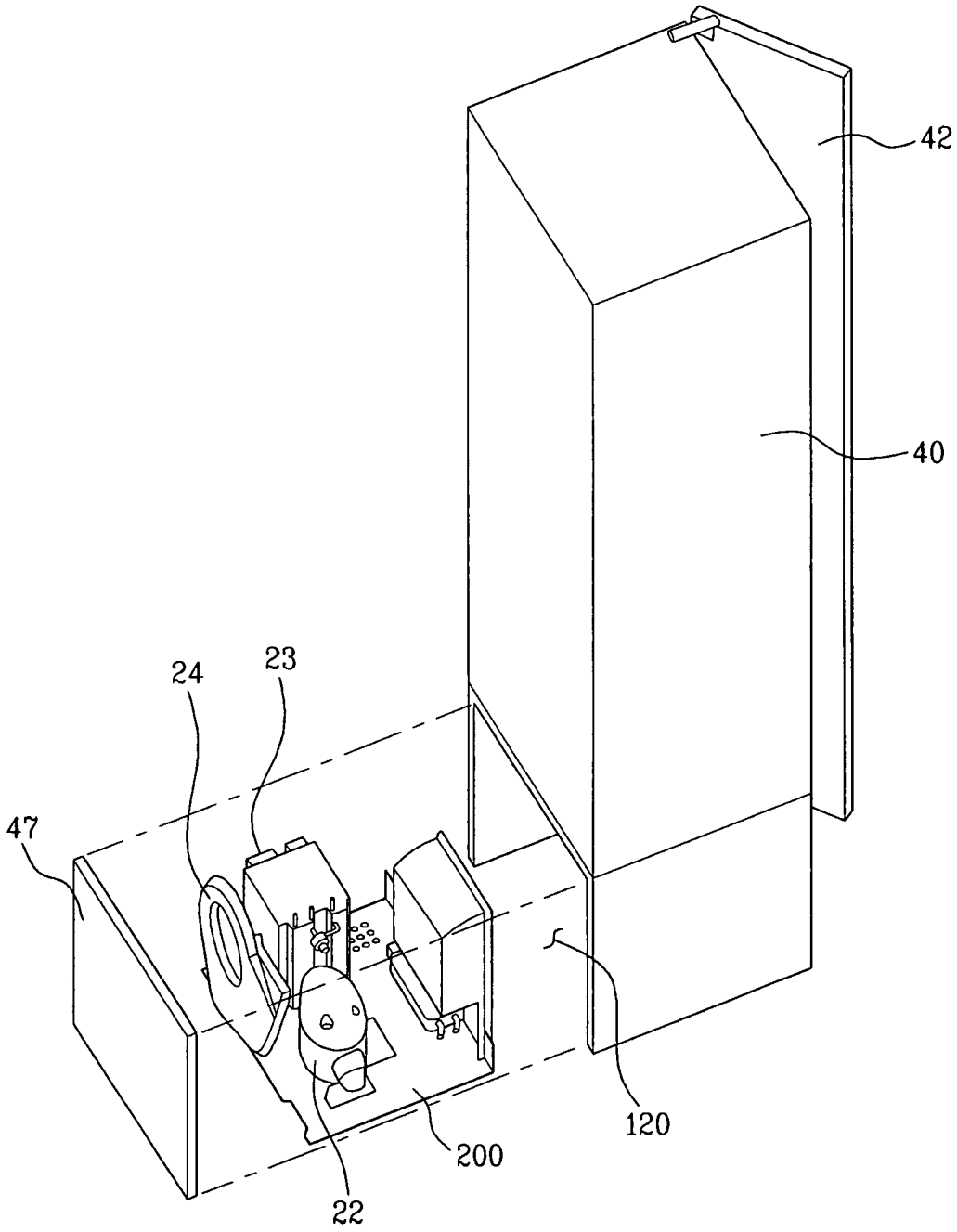
FIG. 2 is a diagram illustrating a base plate having components of a mechanism compartment mounted thereon, being separated from the clothes-treating apparatus.

FIG. 2 illustrates that the components inside the mechanism compartment 110 are mounted on a base plate 200, the base plate 200 being removed completely from the clothes-treating apparatus. The components inside the mechanism compartment 120 may include an air supply device, and a moisture supply device The air supply device, for supplying hot air to the accommodating space 110 to dry the clothes inside the accommodating space, may include a heat exchanger 23, a compressor 22 and the ventilation duct 24. The components constituting the air supply device may be mounted on a base plate 200 that may be removable from the mechanism compartment 120. The base plate 200 defines a removable module and acts as means to support the components being removed from the mechanism compartment 120. The base plate 200 makes it possible to discharge the module as a whole from the mechanism compartment 120.

To easily access the inside of the mechanism compartment 120, it is more preferable to install the components of the mechanism compartment 120 directly on the base plate 200, than to install them on a lower surface of the cabinet 40. Therefore, the base plate 200 having the components mounted thereon, may control the removal of a single module from the cabinet 40.

A second cover 47 of the clothes-treating apparatus shown in FIG. 2 may open a rear, front, or side panel of the mechanism compartment 120 in the cabinet 40. If the second cover 47 is formed at a rear side of the cabinet 40, a user may remove the second cover 47 in the rear of the mechanism compartment 120 and may pull out the base plate 200 having the components mounted thereon from the cabinet 40 or the mechanism compartment 120, to allow maintenance of the components. If the base plate 200 is removed from the cabinet 40, the worker can easily perform maintenance work and repair on the components.

In the embodiment shown in FIGS. 1 and 2, it is not necessary that the first cover 115*a* and the second cover 47 be provided at the same time. An opening may be formed at the partition and/or at a side surface of the cabinet 40. Furthermore, a cover that acts to selectively close the opening may also be provided.

In addition, the second cover 47 need not be entirely removable from the cabinet 40, but may be fixed thereto. For example an end of the second cover 47 may be hingedly-fixed to the cabinet 40. This is similar to the first cover 115 illustrated in FIG. 2.

As discussed above, the covers 115*a* and 47 illustrated in FIGS. 1 and 2 may also be separable from the partition 115 or the cabinet 40 completely, or they may be hinge-secured to be rotatable or they may be fixed coupled in a sliding engagement with the cabinet 40 in a predetermined single direction. For example, a guide member, such as a track, may be provided at a right and left portion of partition 115 so that the first cover 115*a* may slide forward. A guide member may also be provided at side portions of the rear surface of the cabinet 40 so that the second cover 47 may slide upward from the cabinet.

According to an embodiment shown in FIG. 3, the components may be mounted on the base plate 200 in the mechanism compartment 120, as mentioned above. Since the various components are mounted on the base plate 200, the base plate 200 is employed as a bottom of the mechanism compartment 120 and an auxiliary bottom surface may not necessarily be provided.

The base plate 200 may be taken out from the cabinet 40 via the opening created by second cover 47. The second cover 47 may be entirely separated from the cabinet 40 or may be opened via a hinge connection, as discussed above.

To move the base plate 200 outside the cabinet 40 smoothly, with the opening of the second cover 47, auxiliary guide means may be further provided. An example of the guide means of the base plate 200 may be a guide member in which both ends of the base plate 200 are inserted to fix the base plate 200 vertically.

As mentioned above, the opening may be formed at the side portion of the mechanism compartment 120 and guide members 190 may be provided at both inner side surfaces of the cabinet, facing the inside of the mechanism compartment to guide the base plate along toward the opening.

Figure 4A:
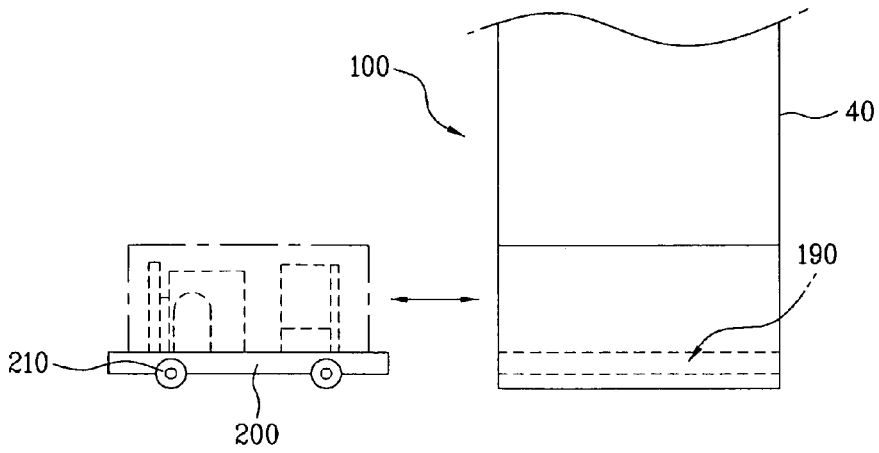
FIG. 4A is a diagram illustrating another embodiment of a clothes-treating apparatus.

FIG. 4A shows that the base plate may be removed from the cabinet 40 having the guide members 190, the base plate 200 providing a modular unit and an installation place for the components of the mechanism compartment 120. The guide member 190 may be a track or an insertion groove of a "⊂" shape (a kind of a concave shape), adapted to received opposite ends of the base plate 200.

The guide members 190 reduces friction between a lower surface of the base plate 200 and a surface below the base plate 200, such as a bottom of the mechanism compartment. Guide members 190 act to maintain a horizontal position of the base plate 200 as well as to help the base plate 200 to be taken out smoothly.

The base plate 200 may include at least one roller 210 provided underneath the base plate 200. The roller 210 may be provided to reduce the friction between the base plate 200 and a surface below the base plate 200 such as a floor where the clothes-treating apparatus is installed. The roller 210 also acts to reduce the stress on the guide members 190 and the friction between the sides of the base plate 200 and the guide members 190.

Figure 4B:
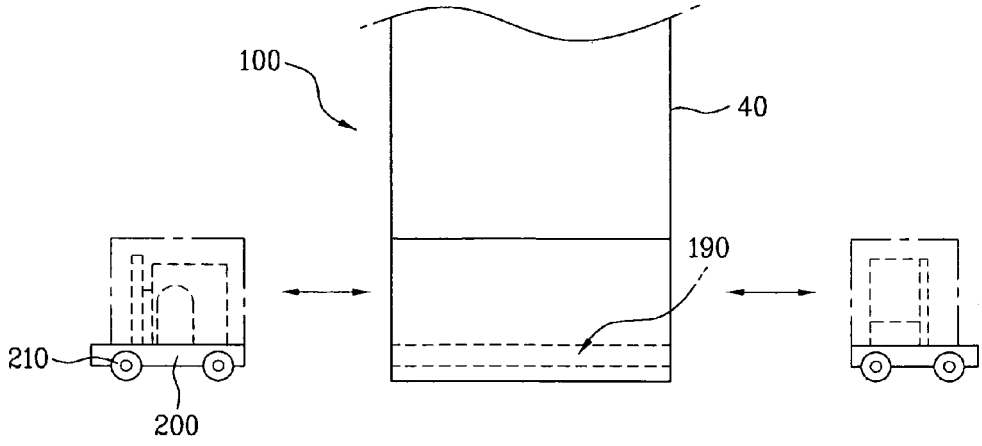
FIG. 4B is a diagram illustrating another embodiment of a clothes-treating apparatus.
Figure 5:
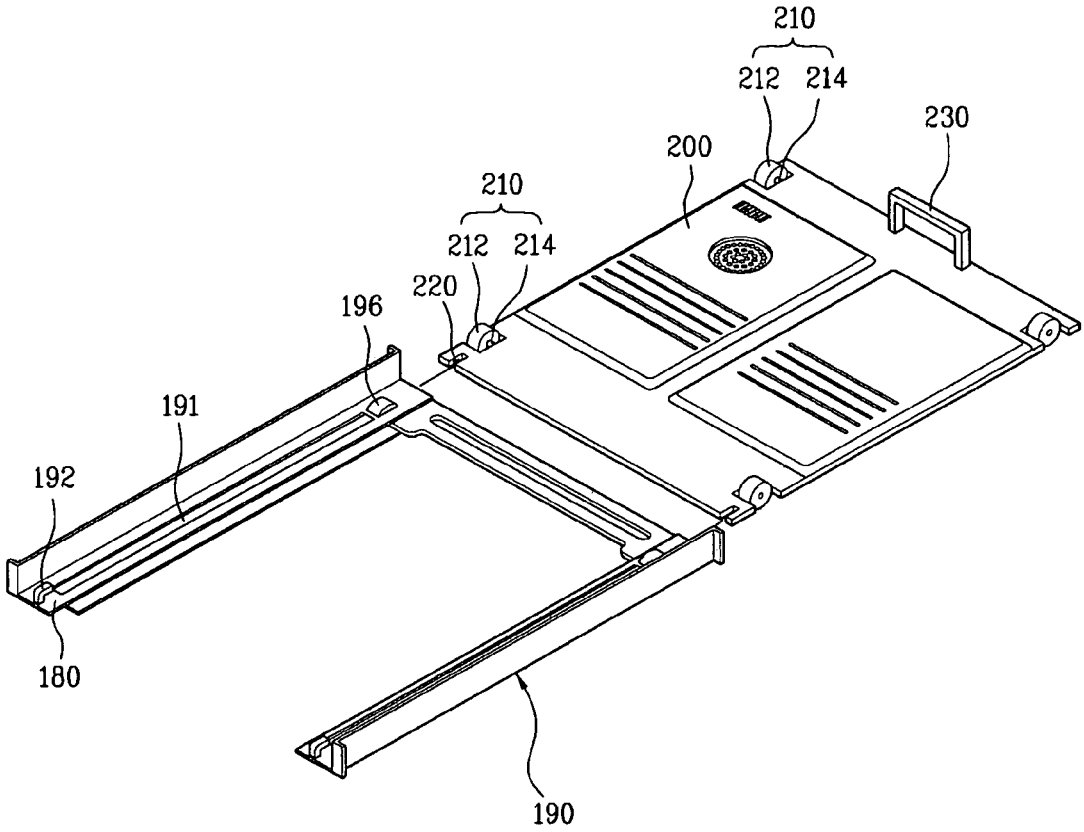
FIG. 5 is a still further embodiment of a clothes-treating apparatus.
Figure 6:
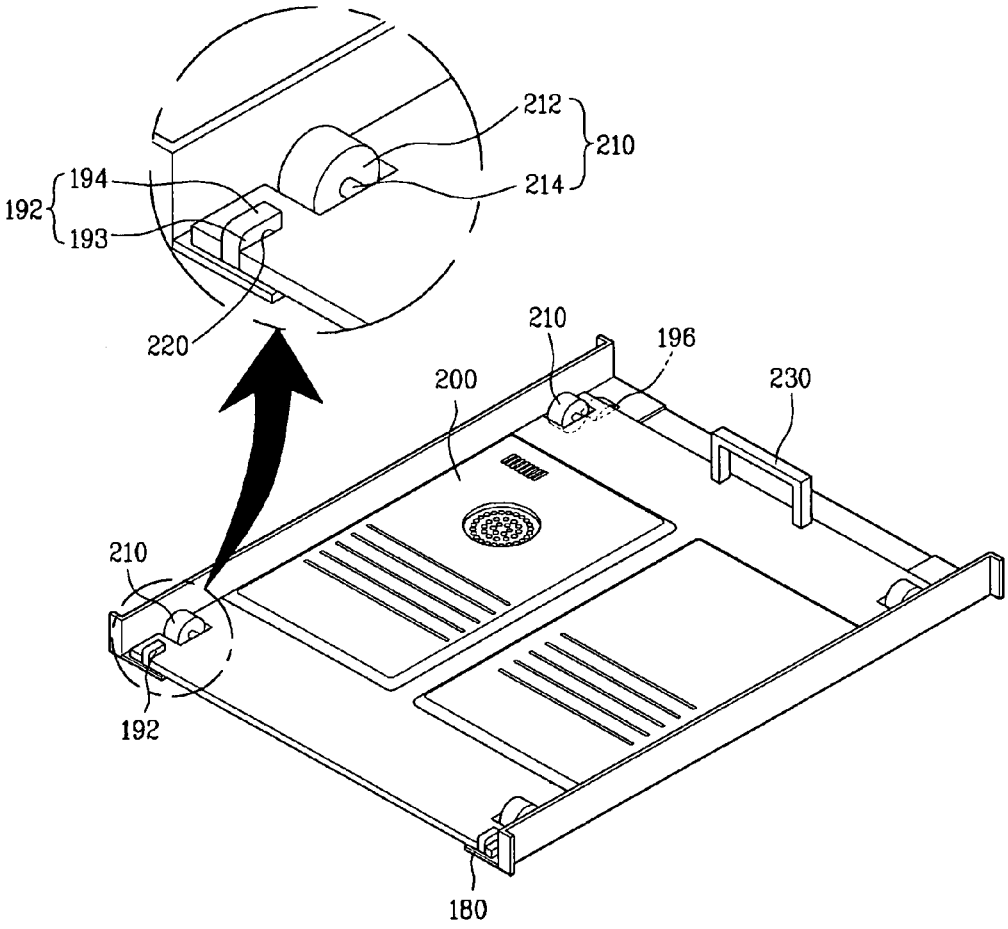
FIG. 6 is a perspective view illustrating key parts of a base plate inserted in a guide member secured to a mechanism compartment shown in FIG. 6.

FIG. 4A refers to an embodiment of a roller which rolls in contact with the floor where the clothes-treating apparatus is installed. FIG. 4B refers to an embodiment wherein the two sub-modules, discussed above, are on rollers and removable through different openings. FIGS. 5 and 6 refer to embodiments having a roller 210, which contacts the guide member 190.

The base plate 200 including the roller 210 will now be described in detail. FIG. 5 illustrates another embodiment of the clothes-treating apparatus. According to the embodiment of FIG. 5, there may be friction between the guide member 190 and the base plate 200. Thus, it is desirable to reduce the friction.

If a roller 210 is installed underneath the base plate 200, i.e. on a lower surface of the base plate 200, the base plate 200 may be smoothly removed from the mechanism compartment 40, leaving the position of the clothes-treating apparatus undisturbed. That is because the roller 210 minimizes the friction between the clothes-treating apparatus and the floor where the clothes-treating apparatus is installed.

To reduce the friction between an inner surface of the guide member 190 and the base plate 200 more, chemicals may be applied on an inner surface of the guide member 190. An auxiliary wheel (not shown) may also be installed at a guide member 190 or a portion where the base plate 200 is in contact with the guide member 190 to reduce friction.

FIG. 5 illustrates a still further embodiment of the clothes-treating apparatus. FIG. 5 refers to a specific embodiment of the above embodiment in that the roller is provided at the base plate 200.

FIG. 5 illustrates the base plate 200 as it is installed in the mechanism compartment 120, omitting the illustration of the installed components, such as the air supply device. The base plate 200 may include the roller 210 to aid in moving or sliding the base plate 200 smoothly. It is preferable that multiple rollers 210 are installed at corners of the base plate 200, so that the tray may be moved with support mostly from the roller 210.

Here, the roller 210 may include a rotatable wheel 212 and a shaft 214 coupled to a center of the wheel 212. That is, the wheel 212 is coupled to the shaft 214 to be secured to the base plate 200. The wheel 212 may rotate about the shaft in a clockwise or counter-clockwise direction.

The base plate 200 may include a projection (not shown) extended in a longitudinal direction of the both opposite sides of the base plate 200. It is preferable that the projection is formed at the portion where the roller 210 is installed. For example, the projection may be positioned in a line connecting the wheels provided at the predetermined portion of the base plate 200. In addition, the projection may be extended downward from the base plate 200.

A guide groove 191 may be formed at an upper surface of the guide member in a longitudinal direction and the roller 210 may move on the guide member 190, while being seated in the guide groove 191. The guide groove 191 may be formed in the mechanism compartment 120 to guide the motion of the roller 210. More specifically, the guide groove 191 may be formed along a longitudinal direction of the frame 180 to guide the sliding motion of the base plate 200.

The guide groove 191 may be recessed deep enough for the roller 210 to be movable where a predetermined portion of the roller 210 is inserted in the guide groove 191. That is, the base plate 200 may move while the wheel 212 is rotating along the guide groove 191.

It is preferable that the guide groove 191 is formed in longitudinal direction of a lower frame 180, being substantially linear-shaped. If the projection is provided at the base plate 200 instead of the roller 210, the projection may be inserted in the guide groove 191. The projection may guide the motion of the base plate 200 in a state of being inserted in the guide groove 191. If the projection is provided in this manner, the length of the guide groove 191 may be similar to the length of the projection. Thus by securely maintaining the projection in the guide groove 191, the base plate 200 may be prevented from being completely separated from the cabinet 40 due to vibration or other eternal forces.

A protrusion 196 may be projected from the guide groove 191 and it is preferable that the protrusion 196 is provided adjacent to where the base plate 200 is inserted in the mechanism compartment 120. That is, the wheel 212 may pass the protrusion 196 before being inserted in the guide groove 191. When assembling the base plate 200 to the mechanism compartment 120, the user can determine whether the base plate 200 is inserted in the right position because of the protrusion 196.

Specifically, when sliding the base plate 200 into the mechanism compartment 120, the base plate 200 passes the protrusion 196 and it is lifted a predetermined height. After the base plate 200 passes the protrusion 196, the base plate 200 then descends a length substantially equivalent to the lifted height. The wheel 212 is also guided by the guide groove 191 in a state of being inserted in the guide groove 191.

Even if the projection (not shown) is provided instead of the roller 210, the base plate 200 may still be lifted a predetermined height when passing the protrusion 196. Here, the projection extends vertically and in a longitudinal direction. As a result, only after the projection having passed the protrusion 196 completely, the base plate 200 may be descended as much as the lifted height.

The protrusion 196 may have a longitudinal cross-section that is triangle or hemisphere shaped. Preferably; the angle of a side portion of the protrusion 196 directly in contact with the wheel 212 when the base plate 200 is inserted, is substantially less than the angle of a side portion in contact with the wheel 212 when the base plate 200 is removed. Accordingly, more power is required to remove the base plate 200 from the mechanism compartment 200 than to insert the base plate 200 is inserted in the mechanism compartment 120. This structure acts to prevent the base plate 200 from separating from the cabinet 40 by itself.

FIG. 6 is a perspective view illustrating key parts when the base plate is inserted in the guide member 190 secured to the mechanism compartment 120. A limiting member 192 may be formed at the guide member 190 or the cabinet 40 having an opening formed therein to limit and determine the insertion depth of the base plate.

According to the embodiments shown in FIGS. 5 and 6, the limiting member 192 may be secured to the guide member 190. However, the limiting member 192 may be positioned at various positions to limit the insertion depth of the base plate 200.

The limiting member 192 is formed in the mechanism compartment 120 to prevent the base plate 200 from being inserted into the mechanism compartment 200 more than a predetermined depth. That is, the limiting member 192 is formed at a predetermined portion of the guide groove 191 and it limits the insertion depth of the base plate 200.

Multiple limiting members 192 may be provided at both side portions of the mechanism compartment 120. The limiting member 192 may include a bent portion 193 and an extended portion 194. The bent portion 193 is perpendicularly bent from the lower frame 180 and the extended portion 194 is extended from the bent portion 193. The limiting member 192 may have an appearance of an approximately perpendicular bend from the lower frame 180. Accordingly, the height and the insertion limit of the base plate 200 in the mechanism compartment 120 may be determined by the limiting member 192.

After the base plate 200 is inserted in the mechanism compartment 120, a horizontal vibration of the base plate 200 may be prevented by the bent portion 193 and a vertical vibration of the base plate 200 may be prevented by the extended portion 194.

The limiting member 192 is not limited to the appearance shown in FIGS. 5 and 6. If the insertion limit of the base plate 200 in the mechanism compartment 120 is determined or the height of the base plate 200 is fixed, the shape of the limiting member 192 may be changeable accordingly.

An insertion groove 220 may be formed at a predetermined portion of the base plate 200 and the limiting member 192 may be inserted in the insertion groove 220. The positioning of the base plate 200 may be secured more efficiently because of the interaction between the insertion groove 220 and the limiting member 192.

That is, the bent portion 193 is directly in contact with a vertical surface of the insertion groove 220 and the extended portion 194 is directly in contact with a horizontal surface extended from the insertion groove 220. As a result, the connection between the limiting member 192 and the base plate 200 may be reinforced and the vibration of the base plate 200 may be efficiently prevented. The protrusion may also be further provided at the guide member 190 in order to prevent the separation of the base plate in a state of being stopped by the limiting member.

As shown in FIG. 6, when the base plate 200 is inserted in the mechanism compartment 120, the roller 210 installed underneath the base plate 200 may move over the protrusion. That is, the wheel 212 may pass the protrusion 196 to be seated securely. Then the position of the base plate 200 may be secured by the protrusion 196 to prevent the base plate 200 from moving in a horizontal direction. In other words, a side surface of the protrusion 196 is in direct contact with the wheel 212 to prevent minute motion of the base plate 200.

The insertion direction of the base plate 200 is limited by the limiting member 192 and the discharge direction of the base plate 200 is limited by the protrusion 196. As a result, the horizontal movement of the base plate 200, especially, the minute side-to-side movement of the base plate 200 may be prevented such that the various components may be kept securely in the mechanism compartment 120.

If the projection is provided instead of the roller 210, the projection may be fixedly secured with an end thereof being in contact with the protrusion 196. That is, when the base plate 200 is secured, any sliding motion may be prevented.

A process of the base plate described above being sliding installed in the mechanism compartment will be explained. When assembling the clothes-treating apparatus, the worker may assemble the accommodating space 110, the mechanism compartment 120 and the partition 115. Then, the worker may mount the components contained in the mechanism compartment 120 on the base plate 200. At this time, it is preferable that the air supply device and the moisture supply device are mounted on the base plate 200.

Hence, the base plate 200 is sliding into the mechanism compartment 120.

Some of the wheels 212 installed at the predetermined portions of the base plate 200 may pass the protrusion 196 and the base plate 200 may be lifted to the predetermined height and descended as much as the lifted height. The predetermined portion of the wheel 212 is inserted in the guide groove 191.

While the base plate 200 is inserted in the mechanism compartment 120, the wheel 212 may be guided by the guide groove 191. Here, the wheel 212 rotates about the shaft 214 included in the wheel 212 within the guide groove 191. A sliding motion of the base plate 200 may be guided by the guide groove 191, which prevents the conventional problem of the base plate 200 being positioned at a wrong portion.

In the meantime, a wheel 212 installed at the lower surface of the base plate 200 may be directly in contact with the protrusion 196 such that the rotation of the wheel 212 is stopped. Thus, the base plate 200 may not be inserted in the mechanism compartment 120 any farther to maintain its right position.

If a projection (not shown) is formed at the base plate 200 instead of the wheel 212, the projection may be fixedly secured with an end of the base plate 200 that is in contact with the protrusion 196. If the base plate 200 is inserted completely, the projection is in contact with a side surface, not the upper surface, of the protrusion 196 and the base plate 200 may be secured, preventing sliding movement in a direction perpendicular to the length of the guide groove 191.

When the base plate 200 is taken out of the mechanism compartment 120, the above process is performed vice versa. If the user needs to access the components provided in the mechanism compartment 120, the above process may be performed. The base plate 200 may be removed to repair or replace the components, including the air supply device, and the base plate 200 may be slid into and out of the mechanism compartment 120.

According to the embodiments shown in FIGS. 6 and 7, a handle 230 may be further provided for the convenience of the user when the base plate 200 is taken out of the mechanism compartment 120. The handle 230 assists in smooth removal of the base plate 200 from the mechanism compartment 120.

Furthermore, the steam spray part of the clothes-treating apparatus may be installed in the mechanism compartment and as a result it is possible for a worker to access, maintain and replace the steam spray part efficiently. Thus work performance may be improved.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A clothes treating apparatus comprising:

a cabinet having an accommodating space where clothes are placed; and a mechanism compartment isolated from the accommodating space of the cabinet by a partition, the mechanism compartment having an accommodating space for a moisture supply device adapted to supply moisture to the accommodating space of the cabinet and an air supply device adapted to supply dry or heated air to the accommodating space of the cabinet;

at least a first and a second opening formed at a surface of the mechanism compartment providing access to the accommodating space of the mechanism compartment, and the first opening and the second opening are not accessible from the accommodating space of the cabinet; and at least two modules disposed in the mechanism compartment, one module including at least one of the moisture supply device and the air supply device, wherein the one module is mounted on a base plate, and the base plate is removable from the mechanism compartment via the at least one of the first and the second opening, wherein a guide member is installed on opposing inner surfaces of the mechanism compartment to guide the motion of the base plate toward the opening, and the guide member includes:

a limiting member to limit the insertion depth of the base plate; and a protrusion adapted to prevent the base plate from separating from the position where the base plate is limited by the limiting member, wherein the base plate comprises an insertion groove adapted to receive the limiting member.

2. The clothes treating apparatus of claim 1, wherein the surface of the mechanism compartment comprises:

at least a first panel and a second panel that allow the first opening and the second opening, respectively, to be selectively opened or closed.

3. The clothes treating apparatus of claim 1, wherein the first opening is at a first surface of the mechanism compartment and the second opening is at a second surface of the mechanism compartment.

4. The clothes treating apparatus of claim 1, wherein each of the at least two modules includes one or more of the components in the mechanism compartment.

5. The clothes treating apparatus of claim 4, wherein the mechanism compartment is provided below the accommodating space of the cabinet.

6. The clothes treating apparatus of claim 1, wherein one of the first and the second opening is provided at a rear surface of the mechanism compartment.

7. The clothes treating apparatus of claim 1, wherein the base plate comprises at least one roller provided at a lower surface of the base plate.

8. A clothes treating apparatus comprising:

a cabinet having an accommodating space where clothes are placed; and a mechanism compartment isolated from the accommodating space of the cabinet by a partition, the mechanism compartment having an accommodating space for a moisture supply device adapted to supply moisture to the accommodating space of the cabinet and an air supply device adapted to supply dry or heated air to the accommodating space of the cabinet;

at least a first and a second opening formed at a surface of the mechanism compartment providing access to the accommodating space of the mechanism compartment, and the first opening and the second opening are not accessible from the accommodating space of the cabinet;

at least two modules disposed in the mechanism compartment, one module including at least one of the moisture supply device and the air supply device; and a base plate where the one module is mounted on, wherein the base plate is removable from the mechanism compartment via the at least one of the first and the second opening, and the base plate has a roller, wherein a guide member is installed on opposing inner surfaces of the mechanism compartment to guide the motion of the base plate toward the opening, and the guide member includes:

a limiting member to limit the insertion depth of the base plate;

a protrusion adapted to prevent the base plate from separating from the position where the base plate is limited by the limiting member; and a guide groove formed at an upper surface of the guide member in a longitudinal direction of the guide member, wherein the roller is inserted in the guide groove and moves along the guide member.

9. The clothes treating apparatus of claim 1, wherein the moisture supply device comprises a device adapted to supply steam to the accommodating space of the cabinet, and the air supply device comprises a heat pump including a compressor adapted to compress refrigerant, and a heat exchanger adapted to exchange heat with the refrigerant and air inside the mechanism compartment.

10. A clothes treating apparatus comprising:

a cabinet having an accommodating space where clothes are placed; and a mechanism compartment separated from the accommodating space of the cabinet by a partition, the mechanism compartment having an accommodating space for a moisture supply device adapted to supply moisture to the accommodating space of the cabinet and an air supply device adapted to supply dry or heated air to the accommodating space of the cabinet;

a first and a second opening formed at a surface of the mechanism compartment providing access to the accommodating space of the mechanism compartment, and the first opening and the second opening are not accessible from the accommodating space of the cabinet; and a module disposed in the accommodating space of the mechanism compartment, wherein the module comprises a first sub-module and a second sub-module, and wherein the first sub-module includes one of the moisture supply device and the air supply device, and the second sub-module includes the other of the moisture supply device and the air supply device;

a first base plate configured to mount the first sub-module, wherein the first base plate is removable from the mechanism compartment via the first opening; and a second base plate configured to mount the second sub-module, wherein the second base plate is removable from the mechanism compartment via the second opening, wherein the first opening and the second opening share a common center plane.

11. The clothes treating apparatus of claim 10, wherein the surface of the mechanism compartment includes at least a first panel and a second panel that allow the first opening and the second opening to be selectively opened or closed.

12. The clothes treating apparatus of claim 10, wherein the first opening is at a first surface of the mechanism compartment and the second opening is at a second surface of the mechanism compartment.

* * * * *